United States Patent [19]

Litchfield et al.

[11] 4,303,737

[45] Dec. 1, 1981

[54] COATING MATERIAL

[75] Inventors: William B. Litchfield, Toton; John T. Gent, South Normanton; James A. S. Graham, Borrowash, all of England

[73] Assignee: Rolls-Royce Limited, Derby, England

[21] Appl. No.: 169,432

[22] Filed: Jul. 16, 1980

[30] Foreign Application Priority Data

Aug. 21, 1979 [GB] United Kingdom ..... 29000/79

[51] Int. Cl.[3] ..... B05D 1/12

[52] U.S. Cl. ..... 428/406; 427/191; 427/192; 427/203; 427/217; 428/433; 428/450; 427/423

[58] Field of Search ..... 428/406, 450, 433; 427/180, 203, 423, 217, 191, 192

[56] References Cited

U.S. PATENT DOCUMENTS

| | | | |
|---|---|---|---|
| 3,321,329 | 5/1967 | de Vries | 427/423 X |
| 3,533,824 | 10/1970 | Terrill et al. | 427/217 X |
| 3,781,170 | 12/1973 | Nakao et al. | 427/217 X |
| 3,877,960 | 4/1975 | Knoss | 427/217 X |

*Primary Examiner*—Shrive P. Beck

*Attorney, Agent, or Firm*—Cushman, Darby & Cushman

[57] ABSTRACT

A powder suitable for flame spraying comprising particles of an alumino silicate glass, each of the particles being hollow and coated with an alloy containing, by weight, 80% nickel, 2.5% aluminium, 15.7% chromium and 1.8% silicon. The resultant coating is particularly suitable for use as a thermal barrier.

17 Claims, 1 Drawing Figure

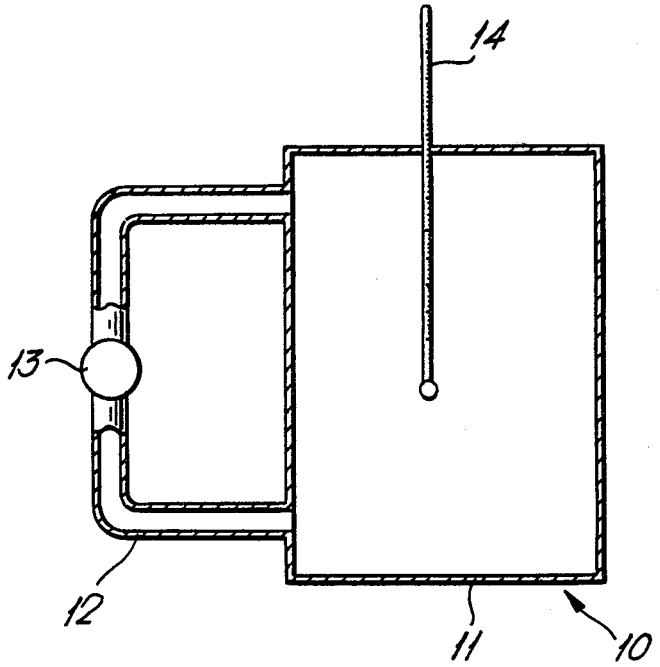
14
13
12
11
10

COATING MATERIAL

This invention relates to coating materials and in particular coating materials which are in powder form.

In the pursuit of greater efficiency and performance the temperatures at which gas turbine engine components are required to operate are continually being increased. This in turn leads to the use of more exotic materials in the construction of the components and perhaps the provision of elaborate cooling systems.

In order to avoid such expensive measures it has been proposed to coat these components with ceramic materials in order to provide a thermal barrier which ensures that component temperatures are maintained within acceptable limits. Such ceramic coatings may, for instance, be applied by techniques such a flame spraying. However ceramics are very brittle and tend to flake off components as those components expand and contract with temperature variations. This effect can be reduced by reducing the thickness of the ceramic coating but such thinner coatings are obviously less effective as thermal barriers.

It is an object of the present invention to provide a coating material, which when coated on a surface, is of relatively low thermal conductivity so as to provide an effective thermal barrier but which nevertheless is sufficiently ductile to resist flaking off the surface as the result of differing rates of thermal expansion of the surface and coating.

According to one aspect of the present invention, a powder suitable for flame spraying comprises particles of a glass, each of said glass particles being hollow and coated with a metal.

Throughout this specification, the term "flame spraying" is intended to include both combustion flame spraying and plasma spraying.

Said metal is preferably a nickel or cobalt based alloy.

Said alloy may contain aluminium and chromium.

Said alloy may additionally contain one or more rare earth metals and/or silicon.

Said glass is preferably an alumino silicate glass.

Said glass preferably constitutes from 5 to 90% by weight of each particle.

Said particles are preferably within the size range 20 to 250 μm diameter.

According to a further aspect of the present invention, a method of coating a surface comprises flame spraying a powder in accordance with any previous statement of invention on to the surface to a depth within the range of 0.2 to 7 mm.

The powder may be mixed with a further metallic or ceramic powder prior to flame spraying.

The coating may constitute one layer of a multilayer coating, the other layers being either metallic or ceramic in nature.

According to a still further aspect of the present invention, a method of coating a surface comprises applying a layer of a powder in accordance with any previous statement of invention to the surface and subsequently heating the powder at a temperature which is sufficiently high to sinter it.

The powder may be suspended in a liquid binder in order to facilitate its application to the surface.

In order to investigate the thermal conductivity of a coating comprising a coating material in accordance with the present invention, a series of comparative tests were carried out. More specifically the thermal conductivity of a sheet nickel test piece flamed sprayed with a powder in accordance with the present invention was compared with the thermal conductivities of two similar test pieces: one uncoated and the other provided with a known ceramic coating.

The powder in accordance with the present invention comprised hollow alumino silicate glass spheres coated with an alloy containing 80% nickel, 2.5% aluminium, 15.7% chromium and 1.8% silicon, all by weight. The glass contained 31.97% $Al_2O_3$, 60.75% $SiO_2$, 4.18% $Fe_2O_3$, 1.91% $K_2O$ and 0.81% Na again all by weight. The uncoated spheres were about 20–200 μm in diameter and had a shell thickness of 2–10 μm.

The glass in this particular powder constituted 10% by weight of each coated particle. However the glass may in fact constitute from 5 to 90% by weight of each particle.

A screen analysis revealed that the particle size of the powder was as follows:

| Tyler Mesh | % |
|---|---|
| −48 +100 | 44.4 |
| −100 +150 | 38.8 |
| −150 +200 | 14.2 |
| −200 | 2.6 |

The powder had a density of 1.28 g/cm$^3$.

The powder may however range in size from 20 to 250 μm diameter.

The powder was combustion flame sprayed on to a nickel plate 2 mm. thick using an acetylene/oxygen combustion mixture with the test piece 20 cm away from the nozzle of the spray gun. The resultant coating was 2 mm. thick and has a density of 2.7 g/cm$^3$.

A similar test piece was then coated with a 0.15 mm bond coat containing by weight 80% Ni and 20% Cr before being coated with zirconia by combustion flame spraying using an acetylene/oxygen combustion mixture. The total thickness of the resultant coating was 0.75 mm, this being the maximum thickness recommended for coatings of this type.

The third test piece was an uncoated piece of nickel plate similar to that used in the preparation of the above test pieces and was 2 mm. thick.

The accompanying FIGURE illustrates a test apparatus utilized in determining thermal conductivity for the three test pieces disclosed above.

The apparatus generally indicated at 10 comprises an insulated copper and steel container 11 having a generally U-shaped pipe 12 attached to it. The test piece 13 is positioned at the mid-point of the pipe 12 so as to constitute a target for the oxygen/acetylene flame of a suitable burner (not shown). The container 11 and the pipe 12 contain 8.2 kg of water, the temperature of which is indicated by a thermometer 14.

The apparatus 10 is arranged so that as the test piece 13 is heated by the oxygen/acetylene flame it in turn raises the temperature of the water contained within the pipe 12 and hence the container 11. It follows therefore that the greater the thermal conductivity of the test piece 13, the greater will be the rise in temperature of the water.

An area of eight square centimeters of each test piece 13 was heated at a distance of 20 cm with an oxygen-/acetylene flame and the rise in temperature of the water from room temperature was duly noted. The average flame temperature across the test piece was found to be 775° C. using an optical pyrometer.

The following results were obtained:

| Test Piece | T °C./1hr. |
|---|---|
| Uncoated Nickel | 30 |
| Nickel with Zirconia coating | 21 |
| Nickel with coating of coated glass spheres | 12.8 |

With the constant eight square centimeter area of the test coupon, the following values for the heat flux were measured:

| Test Piece | Heat Flux (cal/h - cm$^2$) |
|---|---|
| Uncoated Nickel | 35,500 |
| Nickel with Zirconia Coating | 26,000 |
| Nickel with coating of coated hollow glass spheres | 16,000 |

In calculating the thermal conductivity k of each test piece, the following assumptions were made:

(a) the hot face temperature of each test piece was a constant 775° C.

(b) the water temperature was constant at 20° C.+half the temperature rise.

(c) free convection conditions existed at the cold face/-water boundary.

The calculations yielded the following values:

| Test Piece | Thermal Conductivity k (cal - cm/h - cm$^2$ °C.) |
|---|---|
| Uncoated Nickel | 245.0 |
| Nickel with Zirconia Coating | 1.2 |
| Nickel with Coating of Coated Hollow Glass Spheres | 1.09 |

Thus the thermal conductivity of the test piece coated with the coating in accordance with the present invention is lower than that of the test piece coated with zirconia. The thickness of the zirconia coating is less than that of the coating in accordance with the present invention. However it must be borne in mind that the 0.75 mm thickness of the zirconia coating is its maximum recommended thickness whereas the 2 mm coating in accordance with the present invention is not its maximum thickness. In fact we believe that coatings in accordance with the present invention may be up to about 7 mm thick and still function effectively without having tendencies to fracture and flake off their substrates. At the other end of the scale, coatings in accordance with the present invention may have a thickness as low as 0.2 mm and still provide an effective thermal barrier.

The thermal conductivities of surfaces can be greatly influenced by their absorbtion or reflectivity characteristics. The coating in accordance with the present invention is dark and of low density. It may be desirable therefore in certain circumstances to apply a further coating to it in order to increase its reflectivity. A suitable further coating could for instance be a dense, thin flame sprayed coating of zirconia which is generally light coloured. Further coatings may also be applied to the coating in accordance with the present invention in order to increase its resistance to erosion and corrosion. Such further coatings could be either ceramic or metallic in nature depending on the particular application. Moreover coatings in accordance with the present invention could be applied to existing coatings in order, for instance, to enhance bonding between the coating in accordance with the present invention and the coating substrate.

It is also envisaged that in certain circumstances it may be desirable to mix the powder in accordance with the present invention with a further metallic or ceramic powder prior to flame spraying.

In addition to being suitable for combustion spraying, it is envisaged that powders in accordance with the present invention could be plasma sprayed on to a surface or applied to a surface in the form of a slurry with a suitable liquid binder. If the powder is applied in the form of a slurry, subsequent heating steps would be required in order to burn off the binder and sinter the particles. A suitable binder could for instance be an organic resin which will burn off with little residue, for example a polymethacrylic ester resin.

Whilst coatings which are formed by the slurry technique are effective as thermal barriers, their degree of porosity makes them suitable for use in the manufacture of abradable seals. Thus the coatings could be applied to the radially inner surfaces of an axial flow gas turbine engine compressor so as to be abraded in operation by the tips of the rotating aerofoil blades of the compressor.

The present invention has been described with respect to particles comprising hollow alumino silicate glass spheres coated with an alloy of nickel, aluminium, chromium and silicon. It will be appreciated, however, that other suitable alloys and glasses may be utilised. Thus for instance the alloy may be nickel or cobalt based, containing aluminium and chromium and optionally one or more rare earth metals and/or silicon.

It will be seen therefore that since the powder in accordance with the present invention has a metallic content the result coating when that powder has been flame sprayed onto a substrate will be more ductile than a ceramic coating. It will consequently have increased resistance to cracking and flanking off as a result of temperature variations in the substrate and between the substrate and the coating.

We claim:

1. A powder suitable for flame spraying comprising: particles of a glass, each of said particles being hollow and coated with a metal, said metal being selected from the group consisting of a cobalt based alloy and a nickel based alloy, said alloy containing aluminum, chromium and silicon.

2. A powder as claimed in claim 1 wherein said alloy contains at least one rare earth.

3. A powder as claimed in claims 1 or 2 wherein said glass constitutes from 5 to 90% by weight of each particle.

4. A powder as claimed in claims 1 or 2 wherein said glass is an alumino silicate glass.

5. A powder as claimed in claims 1 or 2 wherein said particles are within the size range 20 to 250 μm.

6. A powder suitable for flame spraying comprising particles of a glass, each of said particles being hollow and coated with an alloy comprising, by weight, 80% nickel, 2.5% aluminium, 15.7% chromium, and 1.8% silicon, said glass comprising by weight 31.9% $Al_2O_3$, 60.75% $SiO_2$, 4.18% $Fe_2O_3$, 1.91% $K_2O$ and 0.81%

$Na_2O$ and constituting 10% by weight of each of said particles.

7. A method of providing a surface of a gas turbine engine with a thermal barrier coating which is sufficiently ductile to resist flaking off of the surface as a result of differing rates of thermal expansion of the surface and the coating comprising:

forming a powder consisting of glass particles, each of said glass particles being hollow and being provided with a continuous metal coating; and flame spraying the powder on to the surface of the gas turbine engine to a depth within a range of 0.2 to 0.7 mm., the metal coating of the hollow glass particles bonding adjacent particles to each other and to the surface of the gas turbine engine to form the thermal barrier coating thereon.

8. A method of providing a surface of a gas turbine engine with a thermal barrier coating as claimed in claim 7 wherein said metal is selected from the group consisting of a cobalt based alloy and a nickel based alloy.

9. A method of providing a surface of a gas turbine engine with a thermal barrier coating as claimed in claim 8 wherein said alloy contains aluminum and chromium.

10. A method of providing a surface of a gas turbine engine with a thermal barrier coating as claimed in claim 9 wherein said alloy contains at least one rare earth.

11. A method of providing a surface of a gas turbine engine with a thermal barrier coating as calimed in claim 9 wherein said alloy contains silicon.

12. A method of providing a surface of a gas turbine engine with a thermal barrier coating as claimed in claim 10 wherein said alloy contains silicon.

13. A method of providing a surface of a gas turbine engine with a thermal barrier coating as claimed in claim 7 wherein said glass constitutes from 5 to 90% by weight of each particle.

14. A method of providing a surface of a gas turbine engine with a thermal barrier coating as claimed in claim 7 wherein said glass is an alumino silicate glass.

15. A method of providing a surface of a gas turbine engine with a thermal barrier coating as claimed in claim 7 wherein said particles are within the size range 20 to 250 μm.

16. A method of providing a surface of a gas turbine engine with a thermal barrier coating as claimed in claim 7 wherein a further coating is subsequently applied to said thermal barrier coating, said further coating being selected from the group consisting of metals and ceramics.

17. A method of providing a surface of a gas turbine engine with a thermal barrier coating as claimed in claim 7 wherein said powder is mixed with a further powder prior to flame spraying, said further powder being selected from the group consisting of metals and ceramics.

* * * * *